US008051814B2

(12) United States Patent
Hirayama et al.

(10) Patent No.: US 8,051,814 B2
(45) **Date of Patent: *Nov. 8, 2011**

(54) ENGINE

(75) Inventors: Taku Hirayama, Saitama (JP); Hayato Maehara, Saitama (JP); Takaaki Tsukui, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 487 days.

This patent is subject to a terminal disclaimer.

(21) Appl. No.: 12/035,130

(22) Filed: Feb. 21, 2008

(65) Prior Publication Data

US 2008/0202457 A1 Aug. 28, 2008

(30) Foreign Application Priority Data

Feb. 27, 2007 (JP) ..... 2007-047559

(51) Int. Cl.
*F01L 1/34* (2006.01)

(52) U.S. Cl. ..... 123/90.16; 123/90.48

(58) Field of Classification Search ..... 123/90.16, 123/90.48, 90.55
See application file for complete search history.

(56) References Cited

U.S. PATENT DOCUMENTS

| | | | | |
|---|---|---|---|---|
| 6,076,491 | A * | 6/2000 | Allen | 123/90.16 |
| 2006/0081213 | A1 * | 4/2006 | Yang et al. | 123/321 |
| 2006/0213470 | A1 * | 9/2006 | Maehara et al. | 123/90.16 |

FOREIGN PATENT DOCUMENTS

| | | | |
|---|---|---|---|
| CN | 1260443 | A | 7/2000 |
| EP | 1020619 | A2 | 7/2000 |
| JP | 61-201808 | A | 9/1986 |

* cited by examiner

*Primary Examiner* — Zelalem Eshete
(74) *Attorney, Agent, or Firm* — Birch, Stewart, Kolasch & Birch, LLP

(57) ABSTRACT

A simpler configuration of a mechanism for stopping intake/exhaust valves opened/closed by a valve opening/closing mechanism of a rocker arm. An engine E includes an exhaust valve for opening/closing an exhaust port of an exhaust path with a first exhaust valve spring for energizing the exhaust valve in a valve closing direction. An exhaust valve drive cam is rotated in correspondence with the rotation of an engine crankshaft. A rocker arm is swingably provided between the exhaust valve and the exhaust valve drive cam with one end that abuts on the exhaust valve drive cam being pressed according to rotation of the exhaust valve drive cam and swinging to press the exhaust valve by a press member at the other end to move to the open side. An exhaust valve stopping mechanism is provided between the press member of the rocker arm and the exhaust valve.

17 Claims, 11 Drawing Sheets

ENGINE

CROSS-REFERENCE TO RELATED APPLICATIONS

The present application claims priority under 35 USC 119 to Japanese Patent Application No. 2007-047559 filed on Feb. 27, 2007 the entire contents of which are hereby incorporated by reference.

BACKGROUND OF THE INVENTION

1. Field of the Invention

The present invention relates to an engine having a valve operating mechanism for an opening/closing operation, by a rocker arm, of intake/exhaust valves for opening/closing a communication path between an engine cylinder chamber and an intake or exhaust path. More particularly, to an engine having a valve stopping mechanism capable of stopping the operation of the intake/exhaust valves.

2. Description of Background Art

A valve operating mechanism for intake/exhaust of an engine having a configuration for performing an opening/closing operation by a rocker arm which is made swing by a valve drive cam (called a valve opening/closing mechanism of a rocker arm driving type) is well known. See, for example, JP-A No. S61-201808. Further, it is also known wherein a valve stopping mechanism is provided for stopping the operation of a part or all of intake/exhaust valves in a state where the valve drive cam rotates.

In the case of providing a valve stopping mechanism, in the valve opening/closing mechanism of the rocker arm driving type, as disclosed in JP-A No. S61-201808, a complicated mechanism is necessary in which the swing spindle of the rocker arm is provided with an auxiliary arm and a movable rod and the operation of the rocker arm is interrupted by the movable rod to thereby generate a stopped state. It is therefore expected that the valve stopping mechanism is complicated and expensive.

SUMMARY AND OBJECTS OF THE INVENTION

The present invention has been achieved in consideration of such a problem and an object of an embodiment of the present invention is to simplify a mechanism for stopping intake/exhaust valves in an engine having the intake/exhaust valves opened/closed by a valve opening/closing mechanism of the rocker arm driving type.

To achieve the object according to an embodiment of the present invention, an engine of the present invention includes an exhaust valve 30 provided for a cylinder head of the engine with a valve energizing member, such as a first exhaust valve spring 34*a* for energizing the valve in the direction of closing the valve. A valve drive cam, for example, an exhaust valve drive cam 7, is rotated in correspondence with the rotation of a crankshaft of the engine. A rocker arm is provided swingably between the valve and the valve drive cam, with one end that abuts on the valve drive cam that is pressed according to the rotary drive of the valve drive cam and swings, thereby opening/closing the valve. A valve stopping mechanism is provided for stopping the opening/closing operation of the valve irrespective of the rotary drive of the valve drive cam in accordance with an operational state of the engine. In the engine, the valve stopping mechanism, for example, an exhaust valve stopping mechanism 50, is provided between the other end of the rocker arm and the valve.

In this case, preferably, the valve stopping mechanism has a holder, for example, a plunger holder 51, energized to abut on the other end of the rocker arm and reciprocated in the direction of opening/closing the valve in accordance with the swing of the rocker arm. A stop selecting member, for example, a stop selecting plunger 55, is provided in the holder that is capable of moving between an operating position to open/close the valve in accordance with reciprocating operation of the holder and a stop position to hold the valve in a valve close position irrespective of the reciprocating operation of the holder.

In the engine constructed as described above, preferably, a guide hole, for example, a guide hole 14, is formed so as to extend in the direction of opening/closing the valve, in an engine cylinder head in which the intake or exhaust path is formed. The holder is disposed slidably in the guide hole and has a holder energizing member, for example, a second exhaust valve spring 34*b*, for energizing the holder to the other end of the rocker arm so as to abut on the other end. The stop selecting member includes a stop selecting plunger provided so as to be movable in a direction orthogonal to the sliding direction in the holder and a plunger energizing member, for example, a plunger spring 57, for energizing the stop selecting plunger to one side in the orthogonal direction. In the valve stopping mechanism, a hydraulic fluid chamber to which stop hydraulic fluid pressure is supplied from a fluid supply path in the engine cylinder head is provided in the holder, the stop selecting plunger which receives the stop hydraulic fluid pressure supplied to the hydraulic fluid chamber is pressed to the other side in the orthogonal direction against the plunger energizing member, and the stop selecting plunger is moved and positioned selectively in the operating position or the stop position on the basis of an energizing force of the plunger energizing member and a press force generated by the stop hydraulic fluid pressure acting on the hydraulic fluid chamber.

In the engine, preferably, the valve includes a valve body for opening/closing the communication part and a valve stem connected to the valve body and extending toward the valve stopping mechanism. The tip of the valve stem passes through the plunger holder and faces the stop selecting plunger. In the stop selecting plunger, a step abutment face and a stem receiving part are formed. The step abutment face abuts on the tip of the valve stem and moves the valve in the open/close direction together with the holder when the stop selecting plunger is in the operating position. When the stop selecting plunger is in the stop position, the tip of the valve stem is fit in the step receiving part to move the holder while closing the valve. Further, when the energization force of the plunger energizing member is larger than the press force generated by the stop hydraulic fluid pressure acting on the hydraulic fluid chamber, the stop selecting plunger is positioned in the operating position, and when the press force generated by the stop hydraulic fluid pressure acting on the hydraulic fluid chamber is larger than the energization force of the plunger energizing member, the stop selecting plunger is positioned in the stop position.

In the engine, preferably, the holder has a guide wall for guiding sliding movement in the guide hole of the holder by being slidably fit in the guide hole.

In this case, the guide wall may be formed in the whole outer periphery of the holder, or the guide walls may be formed at equal intervals around the holder. Preferably, the guide wall is provided on the side opposite to the side abutting on the other end of the rocker arm of the holder.

With the engine of the present invention, since the valve stopping mechanism is provided between the other end of the rocker arm and the valve, in the engine having the valve opening/closing mechanism of the rocker arm driving type, the rocker arm does not have a complicated structure but can have a simple structure which is the same as that of a rocker arm used in an ordinary engine having no valve stopping mechanism.

In this case, by constructing the valve stopping mechanism by the holder and the stop selecting member, the valve stopping mechanism can have a simple and light configuration.

The holder is disposed slidably in the guide hole and energized by the holder energizing member. The stop selecting member is constructed by a stop selecting plunger and a plunger energizing member. The stop selecting plunger is selectively positioned between the operating position and the stop position on the basis of the energizing force of the plunger energizing member and the press force generated by the stop hydraulic fluid pressure acting on the hydraulic fluid chamber With this configuration, the valve stopping mechanism having a simple and light configuration can be obtained.

Further, the tip of the valve stem passes through the holder and faces the stop selecting plunger. In the stop selecting plunger, a step abutment face and a stem receiving part are formed. The step abutment face abuts on the tip of the valve stem when the stop selecting plunger is in the operating position. When the stop selecting plunger is in the stop position, the tip of the valve stem is fit in the stem receiving part. When the energization force of the plunger energizing member is larger than the press force generated by the stop hydraulic fluid pressure acting on the hydraulic fluid chamber, the stop selecting plunger is positioned in the operating position. When the press force generated by the stop hydraulic fluid pressure is larger than the energization force of the plunger energizing member, the stop selecting plunger is positioned in the stop position. With this configuration, a valve stopping mechanism having a simple and light configuration can be obtained. When the stop hydraulic fluid pressure is low on the start of the engine or the like, the valve is opened/closed. Thus, also in a very low speed operation on the start of the engine or the like, a large engine output can be obtained, and excellent starting performance can be assured.

By providing the holder with a guide wall for guiding the sliding movement in the guide hole, reciprocating the sliding operation of the holder can be performed smoothly. By forming the guide wall in the whole outer periphery of the holder, a force in any lateral direction acting from the rocker arm can be received by the guide wall, so that reciprocating sliding operation of the holder can be performed more smoothly. By forming the guide walls at equal intervals around the holder, while holding the guiding function, the weight of the holder can be reduced. Further, by providing the guide wall on the side opposite to the side abutting on the other end of the rocker arm of the holder, the force acting from the rocker arm can be received efficiently, and the weight of the valve stopping mechanism can be reduced.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
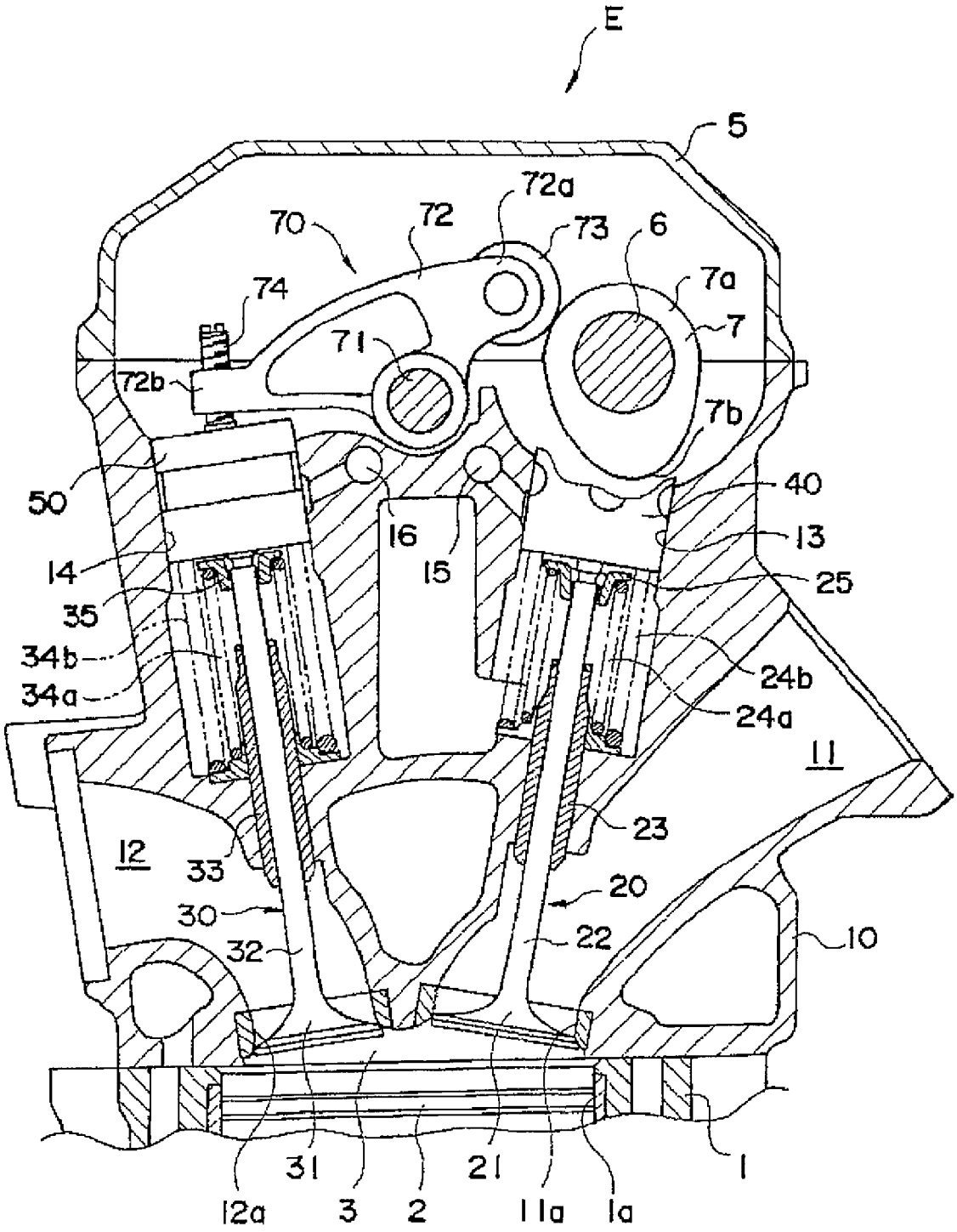
FIG. 1 is a cross section showing the structure of a peripheral portion of a cylinder head in an engine to which the present invention is applied.

Preferred embodiments of the present invention will be described hereinbelow with reference to the drawings. FIG. 1 shows a structure of a portion of a cylinder head in a four-stroke engine E to which the present invention is applied. The engine E is a multi-cylinder engine, and a cross section of only one of the cylinders is shown. A piston 2 is slidably disposed in a cylinder hole 1*a* of a cylinder block 1 as a component of the cylinder. The piston 2 is coupled to an engine crankshaft via a connecting rod to rotate the engine crankshaft in accordance with reciprocation of the piston 2. Since the configuration is not directly related to the present invention and is a known one, it will not be described.

A cylinder head 10 is coupled to the top face of the cylinder block 1. In a state where the cylinder head 10 is attached, a combustion chamber 3 is formed in a portion surrounded by the cylinder hole 1*a* and facing the top face of the piston 2. An intake path 11 and an exhaust path 12 communicated with the combustion chamber 3 are formed in the cylinder head 10. In the communication part among the intake path 11, the exhaust path 12, and the combustion chamber 3, an intake valve 20 and an exhaust valve 30 for opening/closing an intake port 11*a* and an exhaust port 12*a* forming the communication part are provided.

The intake valve 20 has a valve body 21 openably closing the intake port 11*a* and a rod-shaped valve stem 22 connected integrally with the valve body 21 and extending therefrom. The valve stem 22 is slidably guided by a cylindrical stem guide 23 attached to the cylinder head 10, and the intake valve 20 is slidable in the extension direction of the valve stem 22. The tip of the valve stem 22 is energized in the valve closing direction (upward direction in the diagram) by a first intake valve spring (valve energizing member) 24*a* via a retainer 25. In a free state, the valve body 21 closes the intake port 11*a*.

Similarly, the exhaust valve 30 has a valve body 31 openably closing the exhaust port 12*a* and a rod-shaped valve stem 32 connected integrally with the valve body 31 and extending therefrom. The valve stem 32 is slidably guided by a cylindrical stem guide 33 attached to the cylinder head 10, and the exhaust valve 30 is movable in the extension direction of the valve stem 32. The tip of the valve stem 32 is energized in the valve closing direction (upward direction in the diagram) by a first exhaust valve spring (valve energizing member) 34*a* via a retainer 35. In a free state, the valve body 31 closes the exhaust port 12*a*.

In the cylinder head 10, a guide hole 13 extends coaxially from the attachment part of the stem guide 23 for the intake valve 20 to the upper side (outside) and is formed so as to penetrate to the top face side. An intake valve stopping mechanism 40 is disposed slidable in the axial direction in the guide hole 13. On the top face side of the cylinder head 10, a camshaft 6 is disposed so as to extend in the crankshaft direction (direction perpendicular to the drawing face), and an intake valve drive cam 8 provided for the camshaft 6 faces the top end of the intake valve stopping mechanism 40 (refer to FIGS. 13 and 14). The intake valve stopping mechanism 40 is energized to the camshaft direction (toward the upper side in the drawing) by a second intake valve spring 24*b* disposed in the guide hole 13, and the upper end face of the intake valve stopping mechanism 40 is in contact with cam faces 8*a* and 8*b* of the intake valve drive cam 8.

Similarly, a guide hole 14 extends coaxially from the attachment part of the stem guide 33 for the exhaust valve 30 to the upper side (outside) and is formed so as to penetrate to the top face side. An exhaust valve stopping mechanism 50 is disposed slidable in the axial direction in the guide hole 14. On the top face side of the cylinder head 10, a rocker arm mechanism 70 having a rocker arm 72 slidably supported by a supporting shaft 71 so as to extend in the crankshaft direction (direction perpendicular to the drawing face) is provided. A cam follower 73 is rotatably attached to one end (right end) 72*a* of the rocker arm 72, and the cam follower 73 abuts on cam faces 7*a* and 7*b* of an exhaust valve drive cam 7 provided for the camshaft 6. A press member 74 is attached to the other end 72*b* of the rocker arm 72, and the lower end of the press member 74 faces the upper end of the exhaust valve stopping mechanism 50. The press member 74 is screwed in the other end 72*b* of the rocker arm 72. By adjusting the screw amount, the amount of the downward projection can be adjusted. Consequently, a groove 74*a* to which a driver or the like is inserted is formed in the upper end of the press member 74.

The exhaust valve stopping mechanism 50 is energized toward the rocker arm side (toward the upper side in the drawing) by a second exhaust valve spring 34*b* disposed in the guide hole 14, and the upper end face of the exhaust valve stopping mechanism 50 is in contact with the press member 74 to press the press member 74 upward. The rocker arm 72 is energized so as to swing clockwise in the diagram, thereby making the cam follower 73 abut on the cam faces 7*a* and 7*b* of the exhaust valve drive cam 7.

A cylinder head cover 5 is coupled to the top face of the cylinder head 10 so as to cover the cam shaft 6, the rocker ram mechanism 70, and the like. Although not shown, a spark plug facing the combustion chamber 3 is attached to the cylinder head 10, and an intake pipe connected to the intake path 11 and an exhaust pipe connected to the exhaust path 12 are attached to the cylinder head 10. To the intake pipe, an air cleaner, a throttle valve, a fuel injection valve, and the like are attached, and an air-fuel mixture of fuel and air is supplied to the combustion chamber 3 in accordance with the operation of the engine E. Combustion gas generated in the combustion chamber 3 is exhausted from the exhaust passage 12 to the outside via the exhaust pipe.

The present invention is applied to the configuration of the opening the exhaust valve 30 via the exhaust valve stopping mechanism 50 by the rocker arm mechanism 70 in the engine having the above-described configuration. The configuration will be described in detail hereinbelow with reference to FIGS. 2 to 8.

Figure 4:
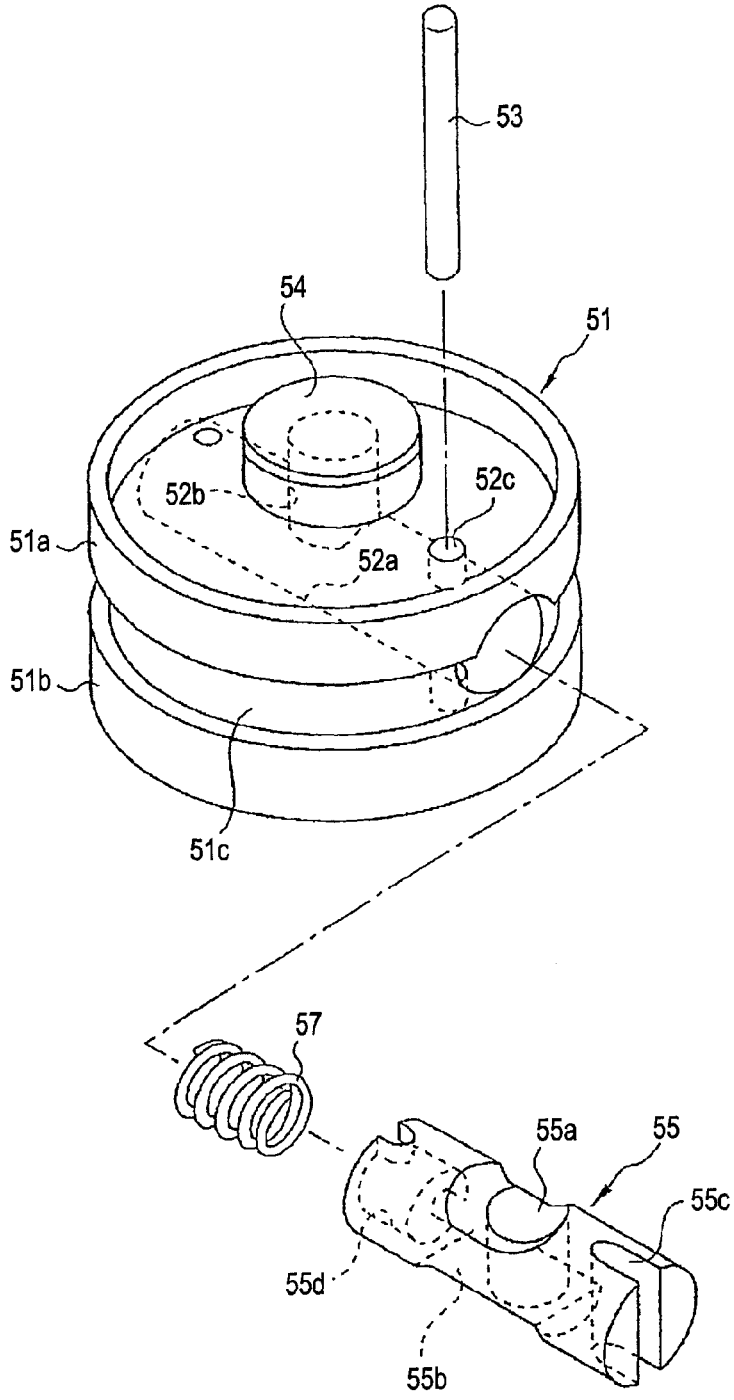
FIG. 4 is an exploded perspective view of members constructing the exhaust valve stopping mechanism.

The exhaust valve stopping mechanism 50 has, as shown in FIG. 4, a plunger holder 51 with an outer shape that is formed cylindrically and slidably fit in the guide hole 14. A stop selecting plunger 55 is slidably fit in a plunger hole 52*a* formed so as to penetrate the plunger holder 51 in the direction orthogonal to the sliding direction of the plunger holder 51. A plunger spring 57 is provided for energizing the stop selecting plunger 55 to one side in the sliding direction (to the right side in the drawing). In the plunger holder 51, a holder-side stem receiving hole 52*b* penetrating the plunger holder 51 in the vertical direction in the center of the outer cylindrical shape is formed. A disc-shaped abutment plate 54 covering the holder-side stem receiving hole 52*b* is fixed on a projecting portion projecting 51*p* formed in an axial direction from a center of an a upper surface 51*up* of plunger holder 51. The size of the holder-side stem receiving hole 52*b* is set larger than the diameter of the end of the valve stem 32 of the exhaust valve 30 so that, as will be described later, the tip of the valve stem 32 can project into the holder-side stem receiving hole 52*b*.

One end of the plunger hole 52*a* formed in the plunger holder 51 is open and the other end is closed. The plunger spring 57 is attached into the plunger hole 52*a* so as to abut on the closed wall. After that, the stop selecting plunger 55 is slidably fit in the plunger hole 52*a*. In the stop selecting plunger 55, a slit 55*c* extending in the radial direction is formed on one end side in the axial direction (the right end side in the diagram). A spring receiving recess 55*d* for receiving the plunger spring 57 is formed on the other end side (the left end side in the diagram). Further, a plunger-side stem receiving hole 55*a* extending orthogonally and passing the center of the axis is formed in the center portion in the axial direction. The size of the plunger-side stem receiving hole 55*a* is set larger than the diameter of the end of the valve stem 32 of the exhaust valve 30 so that, as will be described later, the tip of the valve stem 32 can project into the plunger-side stem receiving hole 55*a*. The lower end opening of the plunger-side stem receiving hole 55*a* is cut in a plane, thereby forming a step abutment face 55*b*.

In the plunger holder 51, further, a pin hole 52*c* positioned near the open end of the plunger hole 52*a* is formed crossing the center of the plunger hole 52*a*, and penetrating in the vertical direction. A stopper pin 53 is fit in the pin hole 52*c*. The stopper pin 53 is fit in the slit 55*c* in the stop selecting plunger 55 fit in the plunger hole 52*a*. The stop selecting plunger 55 is pressed to the right side in the diagram by the plunger spring 57, and the bottom of the slit 55*c* abuts on the stopper pin 53 and is held in the position shown in FIG. 2. In this position, rotation of the stop selecting plunger 55 is regulated by the stopper pin 53, the stem abutment face 55*b* is positioned on the under face side, and the plunger-side stem receiving hole 55*a* is positioned deviated from the holder-side stem receiving hole 52*b* in the axial direction. The upper end of the valve stem 32 of the exhaust valve 30 closely faces the step abutment face 55*b*. The position of the stop selecting plunger 55 at this time will be called an operating position.

On the other hand, a ring-shaped hydraulic fluid receiving groove 51*c* is formed in an intermediate portion on the cylindrical peripheral face of the plunger holder 51. A cylindrical upper guide wall 51*a* and a cylindrical lower guide wall 51*b* are formed with the hydraulic fluid receiving groove 51*c* therebetween. The upper and lower guide walls 51*a*, 51*b* have inner cylindrical-shaped surfaces 51*ai*, 51*bi*, and outer cylindrical-shaped surfaces 51*ao*, 51*bo*. The outer cylindrical-shaped surfaces 51*ao*, 51*bo* of the guide walls 51*a*, 51*b* guide a sliding movement of the plunger holder 51 directly along a cylindrical wall 14*w* of a guide hole 14 formed in the cylinder head 10, and the inner cylindrical-shaped surface 51*ai* of the upper guide wall 51*a* faces the projecting portion 51*p* formed on upper surface 51*up* of the plunger holder 51. Therefore, when the plunger holder 51 is fit in the guide hole 14, the upper and lower guide walls 51*a* and 51*b* are guided so as to be slidably fit in the guide hole 14, and the plunger holder 51 can smoothly slide in the guide hole 14.

Figure 2:
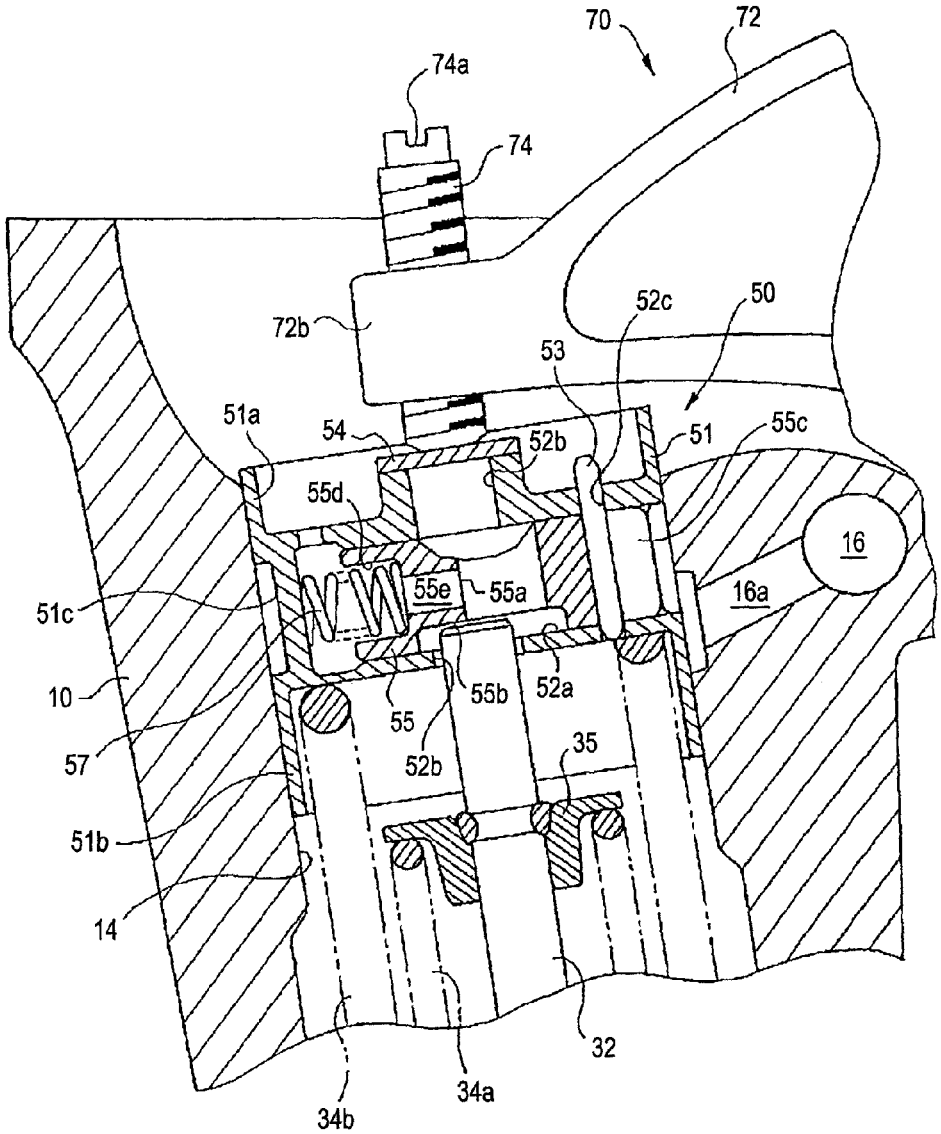
FIG. 2 is a cross section showing the structure of a peripheral portion of an exhaust valve stopping mechanism in the engine.
Figure 3:
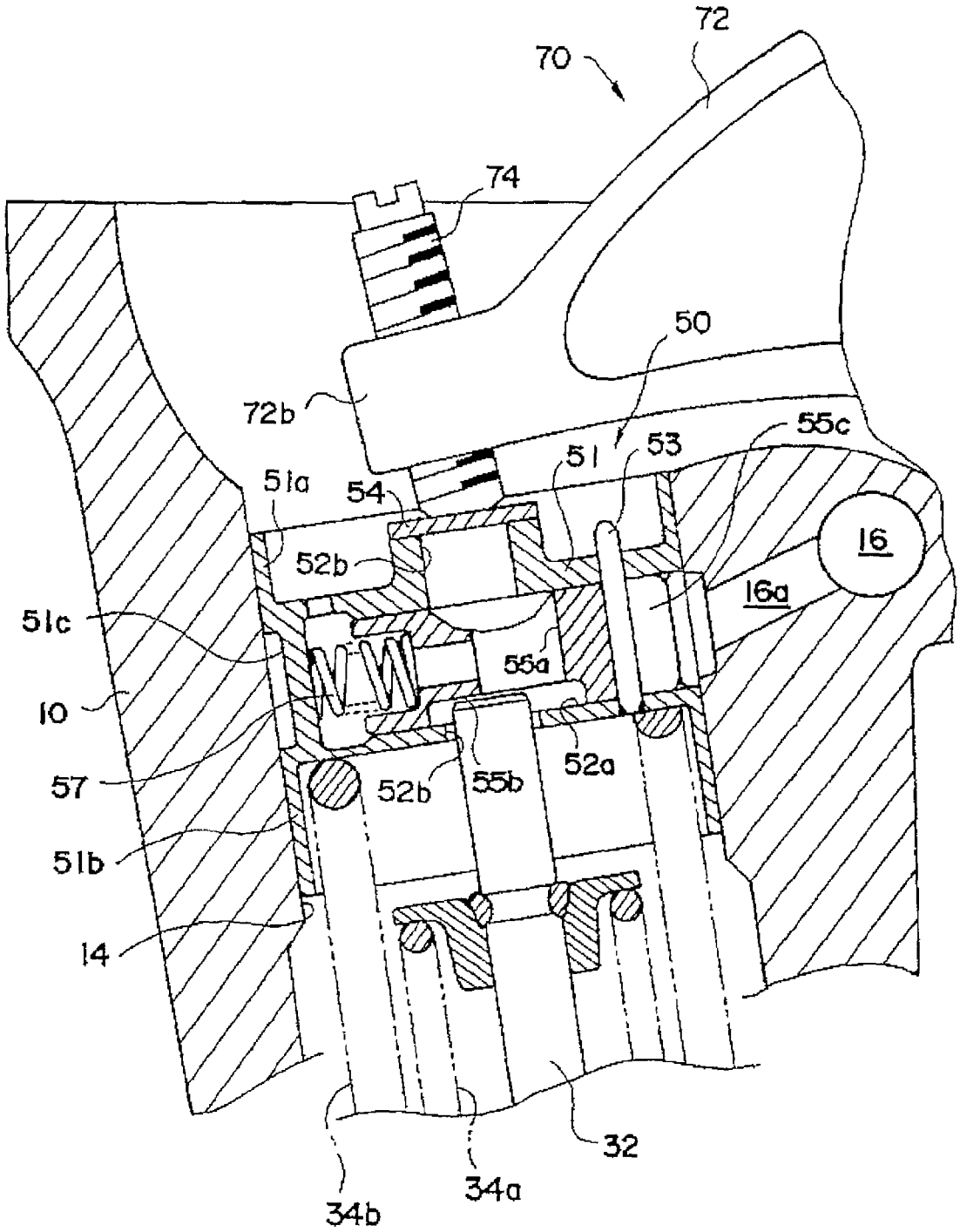
FIG. 3 is a cross section showing the structure of a peripheral portion of the exhaust valve stopping mechanism in the engine.

In the cylinder head 10, an exhaust valve hydraulic fluid supply path 16 is formed, which supplies exhaust valve stop hydraulic fluid supplied from a stop hydraulic fluid pressure supplying device 80 which will be described later into the hydraulic fluid receiving groove 51*c* in the plunger holder 51. A front-end fluid passage 16*a* of the exhaust valve hydraulic fluid supply path 16 is open to the inside of the guide hole 14 and is communicated with the hydraulic fluid receiving groove 51*c* in this portion. The plunger holder 51 is pressed by the rocker arm mechanism 70 and slides vertically in the guide hole 14. When the plunger holder 51 moves upwardly as shown in FIG. 2, and also when the plunger holder 51 moves downwardly as shown in FIG. 3, the hydraulic fluid receiving groove 51*c* at least partially communicates with the front-end fluid passage path 16*a*. The exhaust valve stop hydraulic fluid supplied via the exhaust valve hydraulic fluid supply path 16 is supplied into the hydraulic fluid receiving groove 51*c*. In such a manner, the stop hydraulic fluid supplied into the hydraulic fluid receiving groove 51*c* acts on the right end of the stop selecting plunger 55 to press the stop selecting plunger 55 to the left side.

Next, a stop hydraulic fluid pressure supplying device 80 for the exhaust valve performs control so as to supply exhaust valve stop hydraulic fluid pressure to the exhaust valve hydraulic fluid supply path 16. The stop hydraulic fluid pressure supplying device 80 will be described with reference to FIGS. 7 and 8. The stop hydraulic fluid pressure supplying device 80 has a valve body 81, a spool valve 85 disposed slidably in a spool hole 81*a* formed in the valve body 81, a plug 87 closing the spool hole 81*a* in which the spool valve 85 is disposed at the left end, a spool spring 86 for energizing the spool valve 85 to the right direction, and a solenoid mechanism 90 attached at the right end of the valve body 81.

In the stop hydraulic fluid pressure supplying device 80, an inlet port 82*a* connected to a stop hydraulic pressure supply source P for supplying the stop hydraulic fluid whose pressure is adjusted to a not-shown predetermined hydraulic pressure, an outlet port 82*b* connected to the exhaust valve hydraulic fluid supply path 16, and a drain port 82*c* connected to the drain side are connected to a spool hole 81*a* as shown in the diagram. By performing a control of laterally sliding the spool valve 85 in the spool hole 81*a*, a hydraulic fluid supply stop state (state shown in FIG. 7) and a hydraulic fluid supply state (state shown in FIG. 8) are generated. In the hydraulic fluid supply stop state, communication via the spool hole 81*a* between the inlet port 82*a* and the outlet port 82*b* is interrupted, and the outlet port 82*b* and the drain port 82*c* are communicated with each other via the spool hole 81*a*. In the hydraulic fluid supply state, the inlet port 82*a* and the outlet port 82*b* are communicated with each other via the spool hole 81*a*, and the communication via the spool hole 81*a* between the outlet port 82*b* and the drain port 82*c* is interrupted.

In the valve body 81, a first bypass 83*a* and a second bypass 83*b* are formed. The first bypass 83*a* is communicated with the inlet port 82*a* and the outlet port 82*b* via small holes 82*d* and 82*e* and is provided with, at its end, an open/close port member 84 having an open/close hole 84*a* which is opened/closed by a poppet 91 of the solenoid mechanism 90. The second bypass 83*b* makes the right-side space of the open/close port member 84 and the right end of the spool hole 81*a* communicate with each other.

The solenoid mechanism 90 has a solenoid 92 energized by power supplied via a cable (not shown) connected to a connector 93, the poppet 91 pulled to the right by reception of the excitation force of the solenoid 92, and a poppet spring 94 for energizing the poppet 91 to the left. At the left end of the poppet 91, an open/close projection 91*a* which projects into the open/close hole 84*a* from the right side and closes the open/close hole 84*a* is formed on the left end of the poppet 91. In a non-energizing state of the solenoid 92, the poppet 91 is moved to the left by being energized by the poppet spring 94, and the open/close projection 91*a* enters the open/close hole 84*a* to close the open/close hole 84*a*. On the other hand, when the solenoid 92 is energized, the poppet 91 is moved to the right against the force of the poppet spring 94, and the open/close projection 91*a* is apart from the open/close hole 84*a*.

Figure 7:
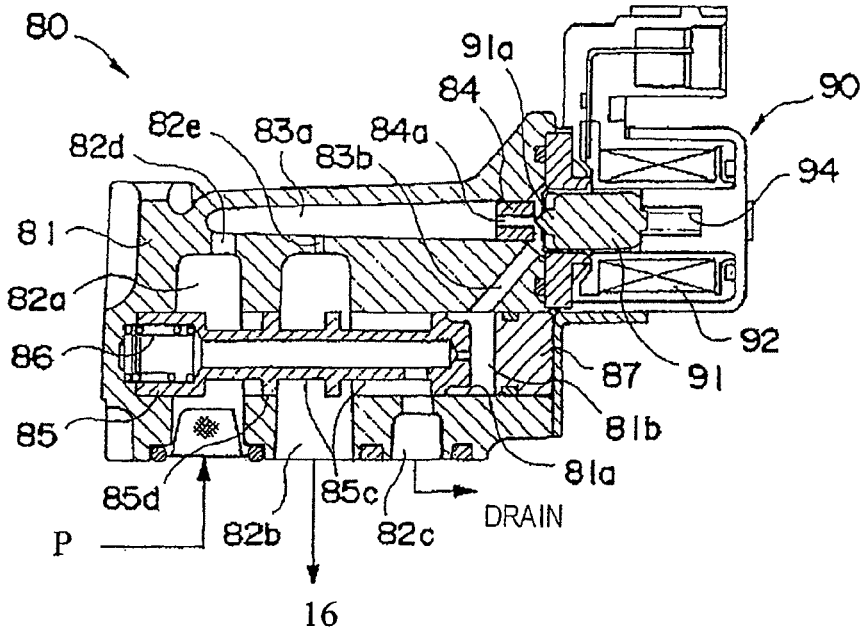
FIG. 7 is a cross section showing the configuration of a stop hydraulic fluid pressure supplying device.

FIG. 7 shows an energization state of the solenoid 92. In the energized state, a force of pulling the poppet 91 by the solenoid 92 acts. The poppet 91 is moved to the right against the force of the poppet spring 94, and the open/close projection 91*a* of the poppet 91 is apart from the open/close hole 84*a* in the open/close port member 84 to open the open/close hole 84*a*. Consequently, the hydraulic fluid supplied from the stop hydraulic fluid supply source P to the inlet port 82*a* passes from the small hole 82*d* through the first bypass 83*a* and the open/close hole 84*a* and is supplied to the second bypass 83*b*. Further, the hydraulic fluid flows into a spool fluid chamber 81*b* surrounded by a plug 87 and the right end face of the spool valve 85 in the spool hole 81*a*.

As a result, the pressure of the hydraulic fluid in the spool fluid chamber 81*b* is moved to the left against the force of the spool spring 86 and is positioned in the position in FIG. 7. By a spool groove 85*c* and a land 85*d* formed as shown in the diagram in the spool valve 85, communication between the inlet port 82*a* and the outlet port 82*b* via the spool hole 81*a* is interrupted, the outlet port 82*b* and the drain port 82*c* are communicated with each other via the spool hole 81*a*. In addition, the hydraulic fluid in the hydraulic fluid supply path 16 is exhausted to the drain side. In such a manner, the hydraulic fluid supply stop state is generated in which the hydraulic pressure for moving the stop selecting plunger 55 against the force to the stop selecting plunger 55 of the plunger spring 57 is not applied to the stop selecting plunger 55. The hydraulic fluid supplied from the inlet port 82*a* into the first bypass 83*a* flows in the outlet port 82*b* via the small hole 82*e*. However, the inflow amount is small and all of the hydraulic fluid is exhausted to the drain side. Thus, the fluid pressure in the hydraulic fluid supply path 16 decreases.

Since the spool valve 85 is forcedly moved to the left by using the pressure of the hydraulic fluid supplied into the spool fluid chamber 81*b*, by properly setting the degree of the stop hydraulic fluid pressure, the spool valve 85 can be moved to the left at an arbitrary speed. In the embodiment, by rapidly moving the spool valve 85 to the left and promptly discharge the hydraulic fluid in the hydraulic fluid supply path 16 connected to the outlet port 82*b* to the drain side, the fluid pressure acting on the stop selecting plunger 55 is rapidly decreased. It quickens the movement of the plunger 55 by the force of the plunger spring 57 at the time of shift from the pause state of the exhaust valve 30 to the operation state. Thus, the response is increased.

Figure 8:
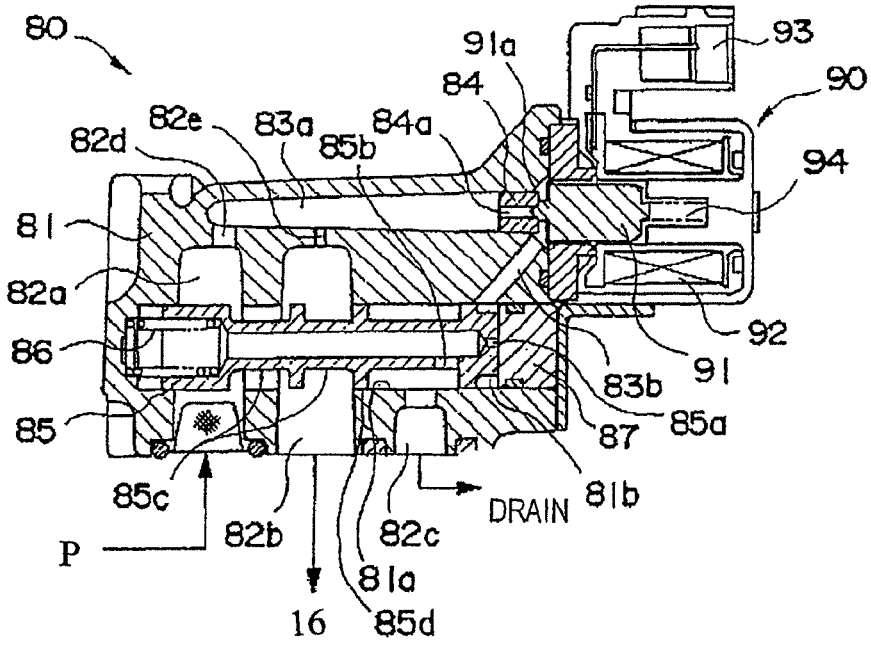
FIG. 8 is a cross section showing the configuration of the stop hydraulic fluid pressure supplying device.

On the other hand, the non-energization state of the solenoid 92 is shown in FIG. 8. Since the force of pulling the poppet 91 to the right by the solenoid 92 does not act, the poppet 91 is moved to the left by the force of the poppet spring 94, and the open/close projection 91*a* of the poppet 91 enters the open/close hole 84*a* in the open/close port member 84 to close the open/close hole 84*a*. Consequently, the hydraulic fluid supplied from the stop fluid pressure supply source P to the inlet port 82*a* and supplied to the first bypass 83*a* does not flow in the second bypass 83*b*. The hydraulic fluid in the spool fluid chamber 81*b* is drained via the small holes 85*a* and 85*b* formed in the spool valve 85.

As a result, the spool valve 85 is moved to the right by the force of the spool spring 86 to the position as illustrated in FIG. 8. By the spool groove 85*c* and the land 85*d* formed as shown in the diagram in the spool valve 85, the inlet port 82*a* and the outlet port 82*b* are communicated with each other via the spool hole 81*a*, and the communication between the outlet port 82*b* and the drain port 82*c* is interrupted. Consequently, the hydraulic fluid supplied to the inlet port 82*a* is supplied to the exhaust valve hydraulic fluid 16, the plunger 55 is moved against the force of the plunger spring 57, and the hydraulic fluid supply state is generated.

The intake valve stopping mechanism 40 will now be described with reference to FIGS. 13 and 14. The present invention is not applied to the mechanism 40, but the operation principle is similar to that of the exhaust valve stopping mechanism 50.

The intake valve stopping mechanism 40 has a bottomed cylindrical valve lifter 48 slidably fit in the guide hole 13. A plunger holder 41 is fit in an insertion hole 48*a* formed in the valve lifter 48. The plunger holder 41 has a configuration almost the same as that of the plunger holder 51 of the exhaust valve stopping mechanism 50. In the plunger holder 41, a plunger hole 42*a* extending in the direction orthogonal to the sliding direction of the valve lifter 48 is formed so as to penetrate there through. A stop selecting plunger 45 is slidably fit in the plunger hole 42*a* and is energized to one side in the sliding direction (to the left in the diagram) by a plunger spring 47. In the plunger holder 41, a holder-side stem receiving hole 42*b* passing the center of the outer cylindrical shape and penetrating in the vertical direction is formed, and the upper end abuts on the bottom face of the valve lifter 48. The holder-side stem receiving hole 42*b* is set larger than the diameter of the tip of the valve stem 22 of the intake valve 20. As will be described later, the size of the tip of the valve stem 22 is set so that it can project to the inside of the holder-side stem receiving hole 42*b* and be received therein.

In the stop selecting plunger 45, a slit 45*c* extending in the radial direction is formed on one end side in the axial direction (the left end side in the diagram). On the other end side (the right end side in the diagram), a plunger-side stem receiving hole 45*a* receiving the plunger spring 47 and extending orthogonally and passing the center of the axis is formed in the center portion in the axial direction. The size of the plunger-side stem receiving hole 45*a* is set larger than the diameter of the end of the valve stem 22 of the intake valve 20 so that, as will be described later, the tip of the valve stem 22 can project into the plunger-side stem receiving hole 45*a*. The lower end opening of the plunger-side stem receiving hole 45*a* is cut in a plane, thereby forming a step abutment face 45*b*.

In the plunger holder 41, further, a pin hole 42*c* positioned near the open end of the plunger hole 42*a*, crossing the center of the plunger hole 42*a*, and penetrating in the vertical direction is formed. A stopper pin 43 is fit in the pin hole 42*c*. The stopper pin 43 is fit in the slit 45*c* in the stop selecting plunger 45 fit in the plunger hole 42*a*. The stop selecting plunger 45 is pressed to the left side in the diagram by the plunger spring 47, and the bottom of the slit 45*c* abuts on the stopper pin 43 and is held in the position shown in FIG. 13. In this position, rotation of the stop selecting plunger 45 is regulated by the stopper pin 43, the stem abutment face 45*b* is positioned on the under face side, and the plunger-side stem receiving hole 45*a* is positioned to be deviated from the holder-side stem receiving hole 42*b* in the axial direction. The upper end of the valve stem 22 of the intake valve 20 closely faces the step abutment face 45*b*. The position of the stop selecting plunger 45 at this time will be called an operating position.

On the other hand, a ring-shaped hydraulic fluid receiving groove 41*c* is formed in an intermediate portion on the cylindrical peripheral face of the plunger holder 41. In the state where the plunger holder 41 is fit in the insertion hole 48*a* in the valve lifter 48, the hydraulic fluid receiving groove 41*c* faces a communication hole 48*b* formed in the outer periphery of the valve lifter 48. In the cylinder head 10, an intake valve hydraulic fluid supply path 17 for supplying passage hydraulic fluid supplied from the stop hydraulic fluid pressure supplying device 80 is formed. A front-end fluid passage 17*a* of the intake valve hydraulic fluid supply path 17 is connected to a hydraulic fluid receiving groove 17*b* formed in a ring shape in the guide hole 13 and, in this part, communicated with the communication hole 48*b* in the valve lifter 48.

A top face 48*c* of the valve lifter 48 is pressed by the intake valve drive cam 8 provided for the camshaft 6 and vertically slides and moves in the guide hole 13*c* together with the plunger holder 41. During the vertical movement, the communication hole 48*b* is at least partly communicated with the hydraulic fluid receiving groove 17*b*. The intake valve stop hydraulic fluid supplied via the hydraulic fluid supply path 17 is supplied from the communication hole 48*b* into the hydraulic fluid receiving groove 41*c*. The intake valve stop hydraulic fluid supplied into the hydraulic fluid receiving groove 41*c* enters the plunger holder 42*a*, and the hydraulic fluid acts on the left end of the stop selecting plunger 45 to press it to the right direction.

The operation of the valve when the engine E as constructed as described above operates will be described hereinbelow. First, the operation in a state where the intake valve stop hydraulic fluid is not supplied to the exhaust valve hydraulic fluid supply path 16 and the intake valve hydraulic fluid supply path 17 will be described. As described above, when the hydraulic fluid is not supplied to the exhaust valve hydraulic fluid supply path 16, in the exhaust valve stopping mechanism 50, a press force overcoming the force of the plunger spring 57 based on the hydraulic fluid pressure is not generated at the end on the side where the slit 55*c* in the stop selecting plunger 55 fit in the plunger hole 52*a* is provided. As shown in FIGS. 2 and 3, the stop selecting plunger 55 is moved to the right by the force of the plunger spring 57 and is positioned in the operating position. In the state where the stop selecting plunger 55 is in the operating position as described above, the plunger-side stem receiving hole 51*a* formed in the stop selecting plunger 55 is positioned deviated from the holder-side stem receiving hole 52*b*, and the tip of the valve stem 32 of the exhaust valve 30 enters the holder-side stem receiving hole 52*b*, and closely faces the stem abutment face 55*b* of the stop selecting plunger 55.

When the engine E is operated in this state, the camshaft 6 is rotated in correspondence with the rotation of the crankshaft, and the rocker arm 72 is made to swing by the exhaust valve drive cam 7 provided for the camshaft 6. More specifically, in a state where the cylindrical cam face 7*a* of the exhaust valve drive cam 7 abuts on the cam follower 73, the rocker arm 72 is in the position shown in FIGS. 1 and 2. In a state where the projection cam face 7*b* abuts on the cam follower 73, the cam follower 73 is pushed upwardly and the rocker arm 72 swings counterclockwise to the position shown in FIG. 3. That is, in the state shown in FIGS. 1 and 2, the press member 74 attached to the left end 72*b* of the rocker arm 72 is in an upward movement position. In the state shown in FIG. 3, the press member 74 is in a downward movement position.

At this time, the exhaust valve stopping mechanism 50 is pushed upward by the second exhaust valve spring 34*b* and the abutment plate 54 abuts on the lower end face of the press member 74. Consequently, the exhaust valve stopping mechanism 50 vertically slides in the guide hole 14 together with the vertical movement of the press member 74. On the other hand, when the press member 74 is in the upward movement position shown in FIGS. 1 and 2, the tip of the valve stem 32 of the exhaust valve 30 enters the holder-side stem receiving hole 52*b* and closely faces the stem abutment face 55*b* of the stop selecting plunger 55. In this state, the exhaust valve 30 lifted by the first exhaust valve spring 34*a* closes the exhaust port 12*a* by the valve body 31. In other words, the attachment position to the rocker arm 72 of the press member 74 is adjusted so that the valve body 31 closes the exhaust port 12*a* and the upper end of the valve stem 32 closely faces the stem abutment face 55*b*.

When the press member 74 is moved downwardly from the upper movement position shown in FIG. 2, together with the press member 74, the exhaust valve stopping member 50 slides downwardly in the guide hole 14 as shown in FIG. 3. Concurrently, the upper end of the valve stem 32 abuts on the stem abutment face 55*b* to press the exhaust valve 30 downwardly, and the valve body 31 is apart from the exhaust port 12*a* to open the exhaust port 12*a*. After that, the engine E is operated, the camshaft 6 is rotated, and the rocker arm 72 is made to swing by the exhaust valve drive cam 7. According to the swing, the exhaust valve 30 is opened/closed.

When the exhaust valve 30 is opened/closed as described above, the stem abutment face 55*b* receives the press force from the valve stem 32 (press force reaction of the exhaust valve drive cam 7). The part for receiving the exhaust valve stop hydraulic fluid pressure (the right end in the diagram of the stop selecting plunger 55) is apart from the stem abutment face 55*b* while sandwiching the plunger-side stem receiving hole 55*a*. Consequently, the influence of the press force (for example, elastic deformation) acting on the stem abutment face 55*b* on the part for receiving the stop hydraulic fluid pressure is suppressed. Deformation of the right end of the stop selecting plunger 55 is very small, so that sealing performance of the portion is maintained to be excellent, and the durability improves. This point is similarly applied to the stop selecting plunger 45 of the intake valve stopping mechanism 40.

Further, by forming a communication hole 55*e* connecting the stem receiving hole 55*a* and the spring receiving recess 55*d* in an overlap portion in the sliding direction with the stem abutment face 55*b* in the stop selecting plunger 55, the weight of the stop selecting plunger 55 is reduced. This improves the sliding response of the stop selecting plunger 55. Further, the weight of the whole exhaust valve stopping mechanism 50 is reduced, and operation response of the exhaust valve 30 also improves. This point is also similarly applied to the intake valve stopping mechanism 40 and the stop selecting plunger 45.

The intake valve stopping mechanism 40 also performs similar operations. More specifically, since the fluid pressure does not act on the left end of the stop selecting plunger 45, the stop selecting plunger 45 is moved to the left by the force of the plunger spring 47 and positioned in the operating position shown in FIG. 13. In this state, the plunger-side stem receiving hole 45*a* formed in the stop selecting plunger 45 is positioned to be deviated from the holder-side stem receiving hole 42*b*, the tip of the valve stem 22 of the intake valve 20 enters the holder-side stem receiving hole 42*b*, and closely faces the stem abutment face 45*b* of the stop selecting plunger 45.

When the engine E is operated in this state and the camshaft 6 is rotated in correspondence with the rotation of the crankshaft, the intake valve stopping mechanism 40 is lifted by the second intake valve spring 24*b* and the top face 48*c* of the valve lifter 48 abuts on the intake valve drive cam 8, so that the valve lifter 48 is pressed downwardly by the intake valve drive cam 8, and the intake valve mechanism 40 is moved in the vertical direction. More specifically, when the cylindrical cam face 8*a* of the intake valve drive cam 8 abuts on the top face 48*c* of the valve lifter 48, the intake valve stopping mechanism 40 is moved upwardly. When the projected cam face 8*b* abuts on the top face 48*b*, the intake valve stopping mechanism 40 is moved downwardly.

Figure 13:
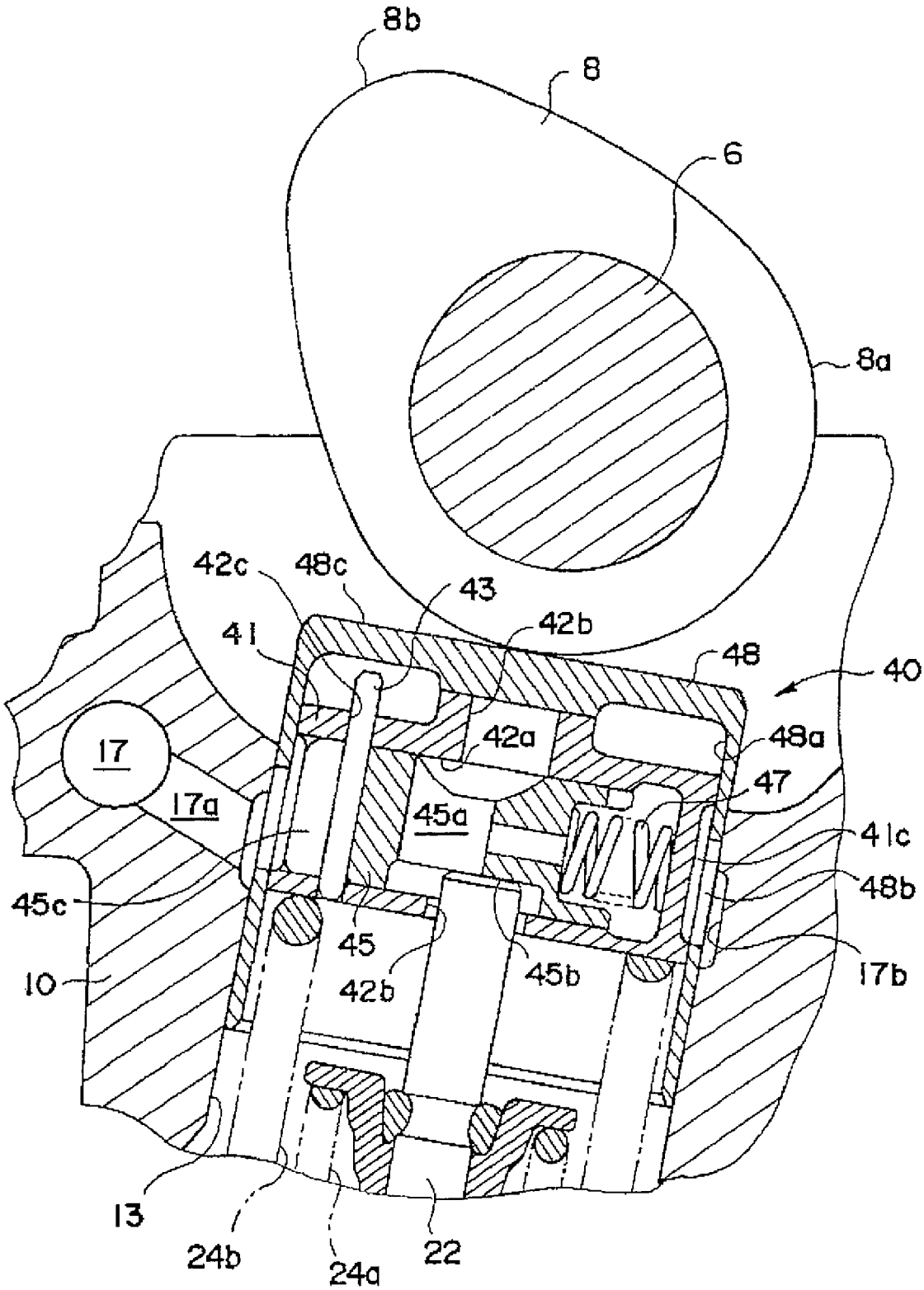
FIG. 13 is a cross section showing the structure of a peripheral portion of an intake valve stopping mechanism in the engine.
Figure 14:
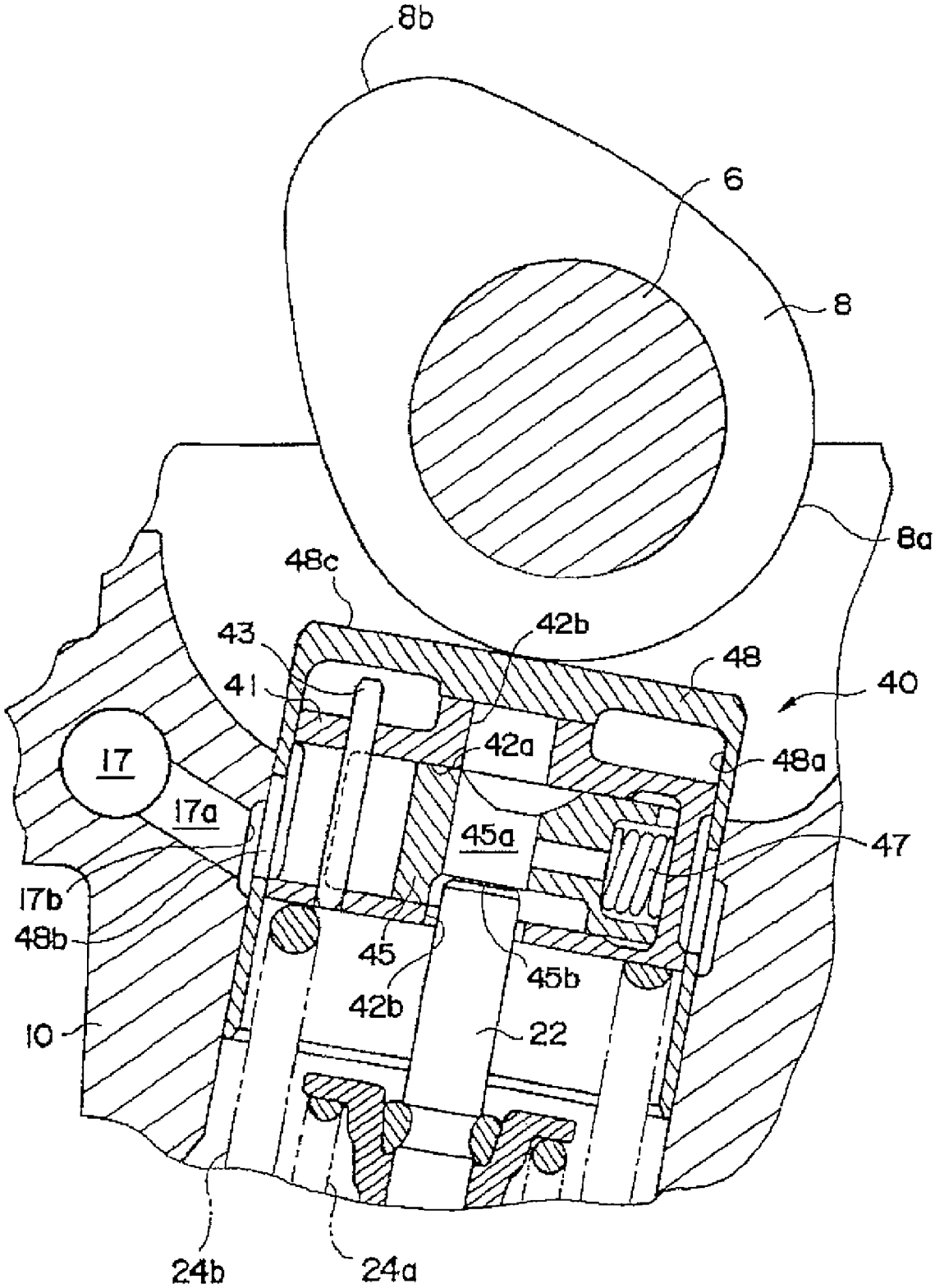
FIG. 14 is a cross section showing the structure of a peripheral portion of the intake valve stopping mechanism in the engine.

On the other hand, when the intake valve stopping mechanism 40 is in the upper movement position shown in FIG. 13, the tip of the valve stem 22 of the intake valve 20 lifted by the first intake valve spring 24*a* enters the holder-side stem receiving hole 42*b* and closely faces the stem abutment face 45*b* of the stop selecting plunger 45. In this state, the valve body 21 of the intake valve 20 closes the intake port 11*a*.

When the intake valve stopping mechanism 40 is moved downwardly from the upper movement position shown in FIG. 13 according to the rotation of the intake valve drive cam 8, the upper end of the valve stem 22 abuts on the stem abutment face 45*b*, the intake valve 20 is pressed downward, and the valve body 21 is apart from the intake port 11*a* and opens the intake port 11*a*. After that, the engine E is operated to rotate the camshaft 6. By the intake valve drive cam 8, the intake valve stopping mechanism 40 is moved in the vertical direction. According to the vertical movement, the intake valve 20 is opened/closed.

As described above, in a state where the intake valve stopping hydraulic fluid is not supplied to the exhaust valve hydraulic fluid supply path 16 and the intake valve hydraulic fluid supply path 17, the engine E is operated. In correspondence with the rotation of the crankshaft, the cam shaft 6 is rotated. By the exhaust valve drive cam 7 provided for the cam shaft 6, the rocker arm 72 is allowed to swing to open/close the exhaust valve 30. By the intake valve drive cam 8, the intake valve 20 is opened/closed. In the cylinder, a normal operation is performed.

Next, the case where the exhaust valve hydraulic fluid is supplied from the stop hydraulic fluid pressure supplying device 80 to the exhaust valve hydraulic fluid supply path 16 and the intake valve stop hydraulic fluid is supplied from the stop hydraulic fluid pressure supplying device 80 to the intake valve hydraulic fluid supply path 17 will be described. A control is performed to simultaneously stop the intake valve 20 and the exhaust valve 30 by supplying the stop hydraulic fluid simultaneously from the stop hydraulic fluid pressure supplying device 80 to the exhaust valve hydraulic fluid supply path 16 and the intake valve hydraulic fluid supply path 17.

Figure 5:
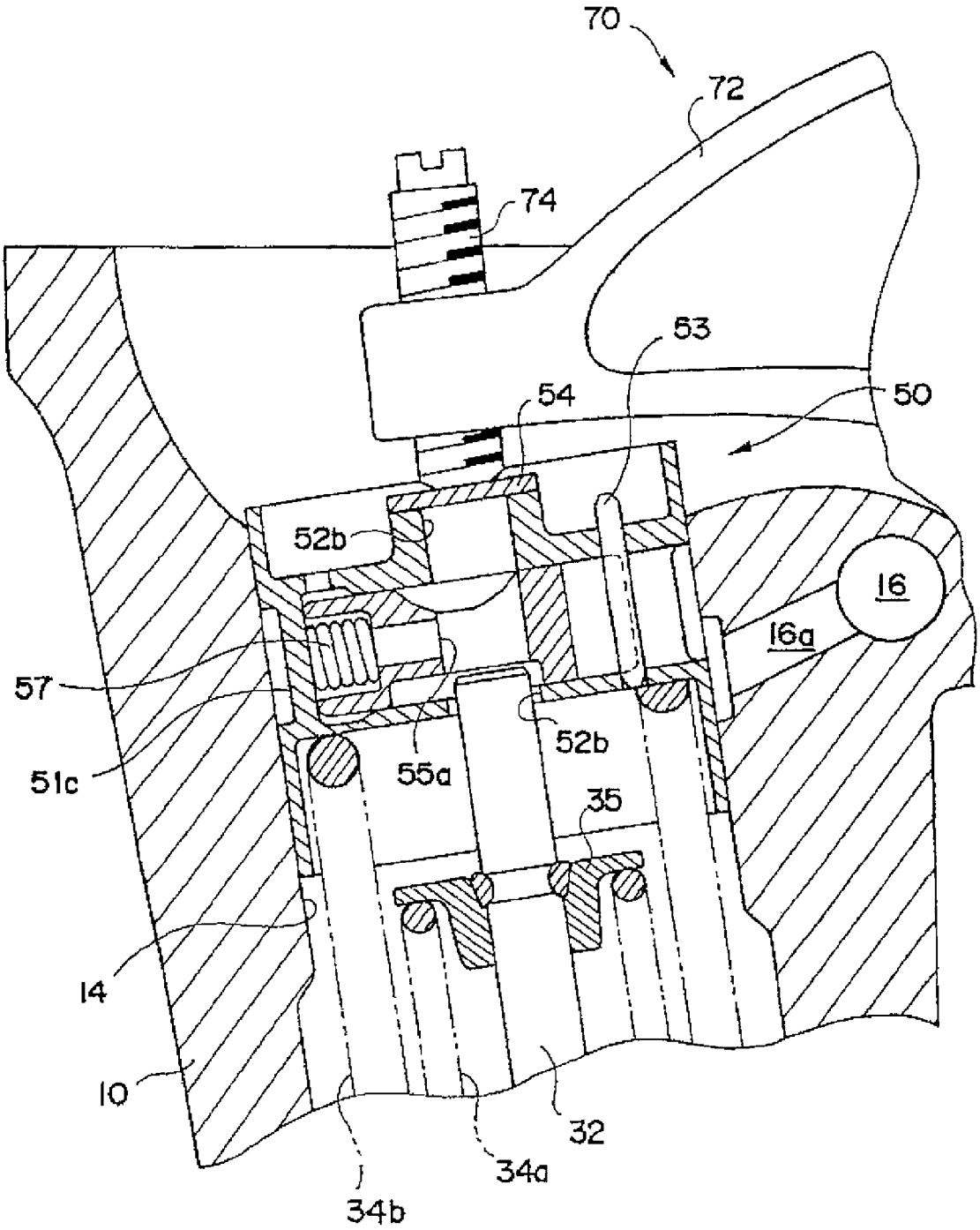
FIG. 5 is a cross section showing the structure of a peripheral portion of the exhaust valve stopping mechanism in the engine.
Figure 6:
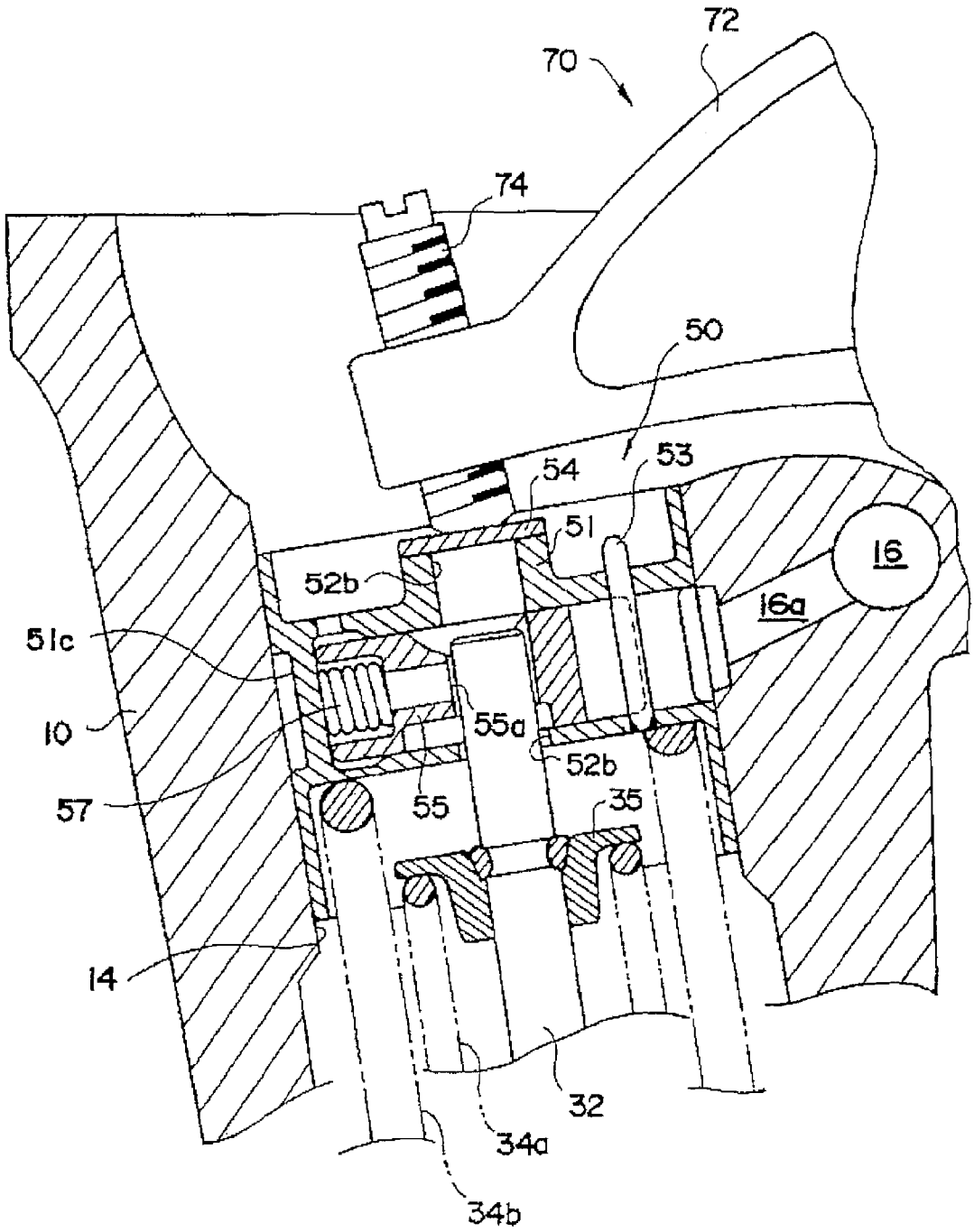
FIG. 6 is a cross section showing the structure of a peripheral portion of the exhaust valve stopping mechanism in the engine.

When the exhaust valve stop hydraulic fluid is supplied to the exhaust valve hydraulic fluid supply path 16, in the exhaust valve stopping mechanism 50, the stop selecting plunger 55 fit in the plunger hole 52*a* receives the press force generated by the hydraulic fluid pressure, is moved to the left against the force of the plunger spring 57 and is positioned in the stop position, as shown in FIGS. 5 and 6. In a state where the stop selecting plunger 55 is in the stop position, the plunger-side stem receiving hole 55*a* formed in the stop selecting plunger 55 matches the holder-side stem receiving hole 52*b* in the vertical direction. The tip of the valve stem 32 of the exhaust valve 30 enters the holder-side stem receiving hole 52*b* and can also enter the plunger-side stem receiving hole 55*a*.

When the engine E is operated in this state, the camshaft 6 is rotated in correspondence with the rotation of the crankshaft, and the rocker arm 72 is swung by the exhaust valve drive cam 7, as described above, the exhaust valve stopping mechanism 50 is pressed by the press member 74 and slides vertically in the guide hole 14. However, when the exhaust valve stopping mechanism 50 is moved in the vertical direction and moved from the position shown in FIG. 5 downwardly as shown in FIG. 6, the tip of the valve stem 32 of the exhaust valve 30 enters the holder-side stem receiving hole 52*b* and also the plunger-side stem receiving hole 55*a*. Consequently, the exhaust valve 30 is held while being lifted by the first exhaust valve spring 34*a*.

As a result, even when the camshaft 6 is rotated, the rocker arm 72 is swung by the exhaust valve drive cam 7, and the exhaust valve stopping mechanism 50 slides vertically in the guide hole 14, the exhaust valve 30 is held while closing the exhaust port 12*a* with the valve body 31. That is, the exhaust valve 30 is stopped in a closed state.

The intake valve stopping mechanism 40 also performs similar operations. Concretely, when the stop hydraulic fluid pressure acts on the left end of the stop selecting plunger 45, the stop selecting plunger 45 receives the hydraulic pressure, is moved to the night against the force of the plunger spring 47, and is positioned in the stop position shown in FIG. 14. In this state, the plunger-side stem receiving hole 45*a* formed in the stop selecting plunger 45 matches the holder-side stem receiving hole 42*b*. The tip of the valve stem 22 of the intake valve 20 enters the holder-side stem receiving hole 42*b* and can also enter the plunger-side stem receiving hole 45*a* in the stop selecting plunger 45.

When the engine E is operated in this state and the camshaft 6 is rotated in correspondence with the rotation of the crankshaft, the valve lifter 48 is pressed downwardly by the intake valve drive cam 8. Even when the intake valve mechanism 40 is moved vertically, the tip of the valve stem 22 of the intake valve 20 enters the holder-side stem receiving hole 42*b* and also the plunger-side stem receiving hole 45*a*. Consequently, the intake valve 20 is held while being lifted by the first intake valve spring 24*a*. As a result, even when the camshaft 6 is rotated and the intake valve stopping mechanism 40 is moved so as to slide in the vertical direction in the guide hole 13 by the intake valve drive cam 8, the intake valve 20 is held while closing the intake port 11*a* with the valve body 21. More specifically, the intake valve 20 is held stopped in the closed state.

As understood from the above description, in the engine E described in the embodiment, at the time of operating the engine in a state where the stop hydraulic fluid is not supplied from the stop hydraulic fluid pressure supplying device 80 and the like to the exhaust valve hydraulic fluid supply path 16 and the intake valve hydraulic fluid supply path 17 (or in a state where the internal fluid pressure is low), when the camshaft 6 is rotated according to the rotation of the crankshaft, normal operations of opening/closing the intake and exhaust valves 20 and 30 are performed. On the other hand, when the stop hydraulic fluid pressure is supplied from the stop hydraulic fluid pressure supplying device 80 or the like to the exhaust valve hydraulic fluid supply path 16 and the intake valve hydraulic fluid supply path 17, regardless of the rotation drive of the camshaft, the intake and exhaust valves 20 and 30 are always held closed, and the cylinder having the intake and exhaust valves is in a stop state.

Consequently, when the stop hydraulic fluid pressure is low at the start of the engine or the like, the normal operations of opening/closing the intake and exhaust valves 20 and 30 are performed. Also in a very-low-speed operating state at the start of the engine or the like, a predetermined large output can be obtained. Thus, an engine having an excellent starting performance is obtained.

At the time of switching a cylinder stop state where the stop hydraulic fluid is supplied from the stop hydraulic fluid supplying device 80 or the like to the exhaust valve hydraulic fluid supply path 16 and the intake valve hydraulic fluid supply path 17 and the intake and exhaust valves 20 and 30 are always held closed to a cylinder operation state where the intake and exhaust valves 20 and 30 are operated by making the exhaust valve hydraulic fluid supply path 16 and the intake valve hydraulic fluid supply path 17 communicate with the drain side in the stop hydraulic fluid pressure supplying device 80 to decrease the hydraulic fluid pressure, as described above, the solenoid 92 is energized in the stop hydraulic fluid pressure supplying device 80 to move the poppet 91 to the right, the fluid pressure is applied to the right end face of the spool valve 85, the spool valve 85 is rapidly moved to the left, and the hydraulic fluid in the valve hydraulic fluid supply path 16 and the intake valve hydraulic fluid supply path 17 is forcedly and promptly discharged to the drain side. Consequently, the response of a switch from the cylinder stop state to the cylinder operation state is high. When the driver performs an operation of opening the throttle in the cylinder stop operation state, the state is promptly shifted to the cylinder operation state by movement of the stop selecting plunger 55 by the energizing force of the plunger spring 57. Thus, the response to a request for increasing an output of the engine improves.

In the above-described exhaust valve stopping mechanism 50, the cylindrical-shaped upper and lower guide walls 51*a* and 51*b* are formed in the outer periphery of the plunger holder 51 with the hydraulic fluid receiving groove 51*c* therebetween. The upper and lower guide walls 51*a* and 51*b* guide the sliding movement along the guide hole 14 so that the plunger holder 51 can smoothly slide in the guide hole 14. The upper and lower guide walls may be also constructed as follows.

The upper and lower guide walls also play the role as a sealing face for preventing leakage of the hydraulic fluid supplied into the hydraulic fluid receiving groove 51*c* to the outside, so that the walls have to be long enough to obtain a sealing effect. However, as understood from FIG. 2 and the like, in the embodiment, both of the upper and lower guide walls 51*a* and 51*b* formed in the outer periphery of the plunger holder 51 are set to have a length equal to or longer than a length necessary for sealing, and the role of the sliding guide is enhanced.

In this case, considering that the press force acting from the press member 74 of the crank arm 72 has, although slightly, a lateral-direction component, it is desirable to make the upper and lower guide walls 51*a* and 51*b* long to some extent to receive the lateral-direction component. Although the lengths of the upper and lower guide walls 51*a* and 51*b* may be set equal to each other, it is preferable to set the lower guide wall 51*b* positioned far from the press member 74 to be longer.

Figure 9:
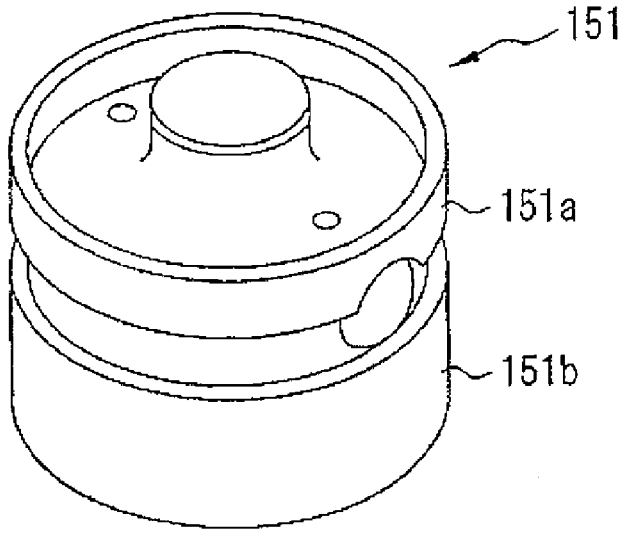
FIG. 9 is a perspective view showing a modification of a plunger holder as a component of the exhaust valve stopping mechanism.

As shown in FIG. 9, a plunger holder 151 in which an upper guide wall 151*a* is set to the short length necessary for sealing and the lower guide wall 151*b* is set to be long may be used.

Figure 10:
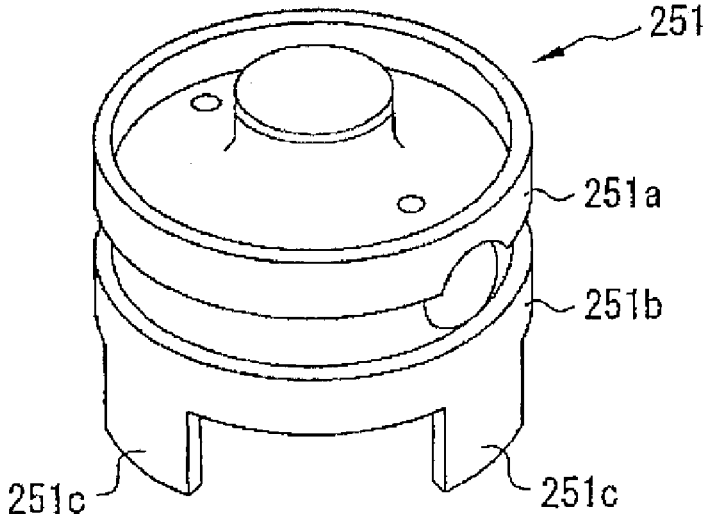
FIG. 10 is a perspective view showing a modification of the plunger holder as a component of the exhaust valve stopping mechanism.

As shown in FIG. 10, a plunger holder 251 may be also used, which is constructed by an upper guide wall 251*a* set to have a short length necessary for sealing and a lower guide wall made by a ring-shaped guide wall 251*b* set to have a length necessary for sealing. A plurality of leg-shaped guide walls 251*c* extend downwardly from the ring-shaped guide wall 251*b* and are provided at equal intervals in the circumferential direction. With such a configuration, the weight of the plunger holder 251 can be reduced while assuring a smooth slidability by the wall length having the guiding function by the leg-shaped guide walls 251*c*.

Figure 11:
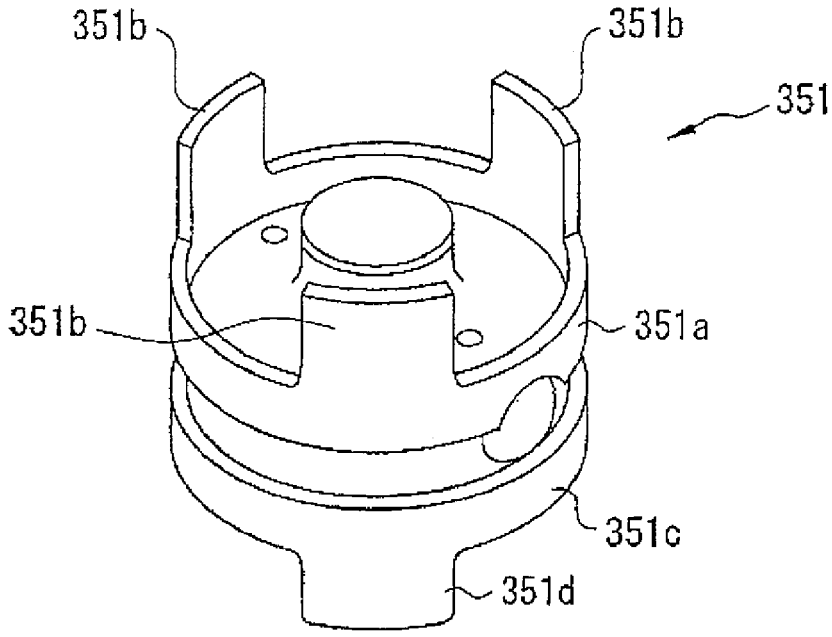
FIG. 11 is a perspective view showing a modification of the plunger holder as a component of the exhaust valve stopping mechanism.

For similar reasons, as shown in FIG. 11, a plunger holder 351 may be used. In the plunger holder 351, the upper guide wall is constructed by a ring-shaped guide wall 351*a* set to have a length necessary for sealing. A plurality of leg-shaped guide walls 351*b* extend upwardly from the ring-shaped guide wall 351*a* and are provided at equal intervals in the circumferential direction. The lower guide wall is constructed by a ring-shaped guide wall 351*c* set to have a length necessary for sealing. A plurality of leg-shaped guide walls 351*d* extend downwardly from the ring-shaped guide wall 351*c* and are provided at equal intervals in the circumferential direction. In this case as well, while holding the guiding function, a reduction in the weight can be realized.

Figure 12:
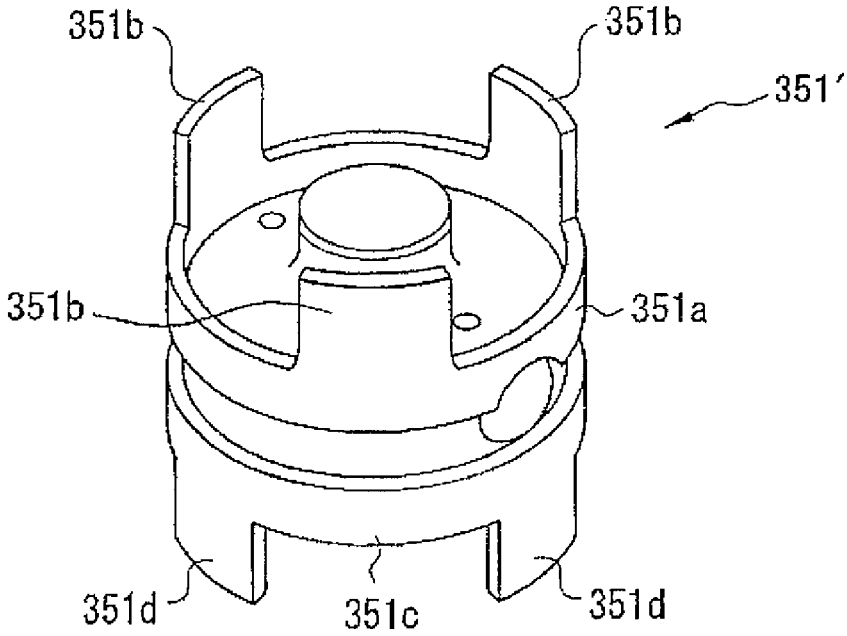
FIG. 12 is a perspective view showing a modification of the plunger holder as a component of the exhaust valve stopping mechanism.

In this configuration, in the plunger holder 351 shown in FIG. 11, the leg-shaped guide walls 351*b* in the upper guide wall and the leg-shaped guide walls 351*d* in the lower guide wall are formed in the same positions in the circumferential direction. Alternatively, as shown in FIG. 12, a plunger holder 351' may be used in which the leg-shaped guide walls 351*d* in the lower guide wall are deviated from the leg-shaped guide walls 351*b* in the upper guide wall so as to be staggered in the circumferential direction.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An engine comprising:

a valve for a cylinder head of the engine;

a valve energizing member for energizing the valve in a direction of closing the valve;

a valve drive cam rotated in correspondence with a rotation of a crankshaft of the engine;

a rocker arm provided swingably between the valve and the valve drive cam, whose one end abuts on the valve drive cam, is pressed according to a rotary drive of the valve drive cam and swings, thereby opening/closing the valve; and a valve stopping mechanism for stopping the opening/closing operation of the valve irrespective of the rotation drive of the valve drive cam in accordance with an operational state of the engine;

wherein the valve stopping mechanism is provided between the other end of the rocker arm and the valve and includes:

a holder energized to abut on the other end of the rocker arm and reciprocated in the direction of opening/closing the valve in accordance with the swing of the rocker arm;

a single stop selecting member provided in the holder and capable of moving between an operating position to open/close the valve in accordance with reciprocating operation of the holder, and a stop position to hold the valve in a valve close position irrespective of the reciprocating operation of the holder, wherein the valve has a valve body for opening/closing the communication part and a valve stem connected to the valve body and extending toward the valve stopping mechanism, and the single stop selecting member is formed with a plunger-side stem receiving hole which is adapted to receive a tip of the valve stem depending on whether the single stop selecting member is in the operating position or the stop position, wherein the holder comprises:

a projecting portion projecting in an axial direction from a center of an upper surface of the holder; and upper and lower guide walls having inner and outer cylindrical-shaped surfaces, the outer cylindrical-shaped surfaces of the guide walls guiding a sliding movement of the holder directly along a cylindrical wall of a guide hole formed in the cylinder head, and the inner cylindrical-shaped surface of the upper guide wall facing the projecting portion.

2. The engine according to claim 1, wherein the guide hole of the cylinder head is formed so as to extend in the direction of opening/closing the valve, in an engine cylinder head in which the intake or exhaust path is formed;

the holder has a holder energizing member for energizing the holder to the other end of the rocker arm so as to abut on the other end;

the single stop selecting member is a single stop selecting plunger provided so as to be movable in a direction orthogonal to the sliding direction in the holder, and a plunger energizing member at one end of the single stop selecting plunger for energizing the single stop selecting plunger in the orthogonal direction;

in the valve stopping mechanism;

a hydraulic fluid chamber, to which stop hydraulic fluid pressure is supplied from a fluid supply path in the engine cylinder head, is provided in the holder, the single stop selecting plunger which receives the stop hydraulic fluid pressure supplied to the hydraulic fluid chamber is pressed to the other side in the orthogonal direction against the plunger energizing member, and the single stop selecting plunger is moved in one direction and positioned selectively in the operating position or is moved in an opposite direction to the stop position on the basis of an energizing force of the plunger energizing member with a press force generated by the stop hydraulic fluid pressure acting on the hydraulic fluid chamber.

3. The engine according to claim 1, wherein the tip of the valve stem passes through the holder and faces the single stop selecting plunger;

in addition to the valve stem receiving hole, the single stop selecting plunger includes a step abutment face;

the step abutment face abutting on the tip of the valve stem and moving the valve in the open/close direction together with the holder when the single stop selecting plunger is in the operating position; and the stem receiving hole in which the tip of the valve stem is fit, allowing the holder to slide in the guide hole, but closing the valve when the single stop selecting plunger is in the stop position;

when an energizing force of the plunger energizing member is larger than a press force generated by the stop hydraulic fluid pressure acting on the hydraulic fluid chamber, the single stop selecting plunger is positioned in the operating position, and when the press force generated by the stop hydraulic fluid pressure acting on the hydraulic fluid chamber is larger than the energizing force of the plunger energizing member, the single stop selecting plunger is positioned in the stop position.

4. The engine according to claim 1, wherein the upper and lower guide walls are spaced apart from each other in the axial direction of the holder.

5. The engine according to claim 1, wherein the upper and lower guide walls are formed on a whole outer periphery of the holder.

6. The engine according to claim 1, wherein the holder further comprises:

a disc-shaped abutment plate fixed to an upper end of the projecting portion, the disc-shaped abutment plate of the holder energized to abut against a pressing member mounted on other end of the rocker arm.

7. The engine according to claim 1, wherein the holder further comprises:

a holder-side stem receiving hole penetrating through the projecting portion, and a disc-shaped abutment plate fixed to an upper end of the projecting portion and covering the holder-side stem receiving hole, the disc-shaped abutment plate of the holder energized to abut against a pressing member mounted on other end of the rocker arm.

8. The engine according to claim 2, wherein the lower guide wall is provided on the side opposite to the side abutting on the other end of the rocker arm of the holder.

9. The valve stopping mechanism adapted to be used with an engine according to claim 1, wherein a ring-shaped hydraulic fluid receiving groove is formed between the outer cylindrical-shaped surfaces of the upper and lower guide walls on a cylindrical peripheral face of the holder.

10. A valve stopping mechanism adapted to be used with an engine comprising:

a valve for a cylinder head of the engine;

a valve energizing member for energizing the valve in a direction of closing the valve;

a valve drive cam rotated in correspondence with a rotation of a crankshaft of the engine;

a rocker arm provided swingably between the valve and the valve drive cam, said rocker arm including one end in abutment with the valve drive cam for pressing according to a rotary drive of the valve drive cam and for swinging, thereby opening/closing the valve; and a valve stopping mechanism for stopping the opening/closing operation of the valve irrespective of the rotational drive of the valve drive cam in accordance with an operational state of the engine, said valve stopping mechanism being provided between the other end of the rocker arm and the valve, the valve stopping mechanism comprises:

a holder energized to abut on the other end of the rocker arm and reciprocated in the direction of opening/closing the valve in accordance with the swing of the rocker arm; and a single stop selecting member provided in the holder and capable of moving between an operating position to open/close the valve in accordance with reciprocating operation of the holder, and a stop position to hold the valve in a valve close position irrespective of the reciprocating operation of the holder, wherein the valve has a valve body for opening/closing the communication part and a valve stem connected to the valve body and extending toward the valve stopping mechanism, and the single stop selecting member is formed with a plunger-side stem receiving hole which is adapted to receive a tip of the valve stem depending on whether the single stop selecting member is in the operating position or the stop position, wherein the holder comprises:

a projecting portion projecting in an axial direction from a center of an upper surface; and upper and lower guide walls having inner and outer cylindrical-shaped surfaces, the outer cylindrical-shaped surfaces of the guide walls guiding a sliding movement of the holder directly along a cylindrical wall of a guide hole formed in the cylinder head, and the inner cylindrical-shaped surface of the upper guide wall facing the projecting portion.

11. The valve stopping mechanism adapted to be used with an engine according to claim 10, wherein the guide hole of the cylinder head is formed so as to extend in the direction of opening/closing the valve, in an engine cylinder head in which the intake or exhaust path is formed;

the holder has a holder energizing member for energizing the holder to the other end of the rocker arm so as to abut on the other end;

the single stop selecting member is a single stop selecting plunger provided so as to be movable in a direction orthogonal to the sliding direction in the holder, and a plunger energizing member at one end of the single stop selecting plunger for energizing the single stop selecting plunger in the orthogonal direction;

in the valve stopping mechanism;

a hydraulic fluid chamber, to which stop hydraulic fluid pressure is supplied from a fluid supply path in the engine cylinder head, is provided in the holder, the single stop selecting plunger which receives the stop hydraulic fluid pressure supplied to the hydraulic fluid chamber is pressed to the other side in the orthogonal direction against the plunger energizing member, and the single stop selecting plunger is moved in one direction and positioned selectively in the operating position or is moved in an opposite direction to the stop position on the basis of an energizing force of the plunger energizing member with a press force generated by the stop hydraulic fluid pressure acting on the hydraulic fluid chamber.

12. The valve stopping mechanism adapted to be used with an engine according to claim 10, wherein the tip of the valve stem passes through the holder and faces the single stop selecting plunger;

in addition to the valve stem receiving hole, the single stop selecting plunger includes a step abutment face;

the step abutment face abutting on the tip of the valve stem and moving the valve in the open/close direction together with the holder when the single stop selecting plunger is in the operating position; and the stem receiving hole in which the tip of the valve stem is fit, allowing the holder to slide in the guide hole, but closing the valve when the single stop selecting plunger is in the stop position;

when an energizing force of the plunger energizing member is larger than a press force generated by the stop hydraulic fluid pressure acting on the hydraulic fluid chamber, the single stop selecting plunger is positioned in the operating position, and when the press force generated by the stop hydraulic fluid pressure acting on the hydraulic fluid chamber is larger than the energizing force of the plunger energizing member, the single stop selecting plunger is positioned in the stop position.

13. The valve stopping mechanism adapted to be used with an engine according to claim 10, wherein the upper and lower guide walls are spaced apart from each other in the axial direction of the holder.

14. The valve stopping mechanism adapted to be used with an engine according to claim 13, wherein the upper and lower guide walls are formed on a whole outer periphery of the holder.

15. The valve stopping mechanism adapted to be used with an engine according to claim 10, wherein a ring-shaped hydraulic fluid receiving groove is formed between the outer cylindrical-shaped surfaces of the upper and lower guide walls on a cylindrical peripheral face of the holder.

16. The valve stopping mechanism adapted to be used with an engine according to claim 10, wherein the holder further comprises:

a disc-shaped abutment plate fixed to an upper end of the projecting portion, the disc-shaped abutment plate of the holder energized to abut against a pressing member mounted on other end of the rocker arm.

17. The valve stopping mechanism adapted to be used with an engine according to claim 10, wherein the holder further comprises:

a holder-side stem receiving hole penetrating through the projecting portion, and a disc-shaped abutment plate fixed to an upper end of the projecting portion and covering the holder-side stem receiving hole, the disc-shaped abutment plate of the holder energized to abut against a pressing member mounted on other end of the rocker arm.

* * * * *